United States Patent [19]

Mori

[11] Patent Number: 4,884,518

[45] Date of Patent: Dec. 5, 1989

[54] OVERCASTING ATTACHMENT FOR USE WITH A SEWING MACHINE

[76] Inventor: Mikio Mori, 12-2, Chidori-Cho 3-Chome, Ogaki-shi, Gifu-ken 503, Japan

[21] Appl. No.: 210,512

[22] PCT Filed: Oct. 27, 1987

[86] PCT No.: PCT/JP87/00823

§ 371 Date: Jun. 15, 1988

§ 102(e) Date: Jun. 15, 1988

[87] PCT Pub. No.: WO88/03187

PCT Pub. Date: May 5, 1988

[30] Foreign Application Priority Data

Oct. 31, 1986 [JP] Japan ..... 61-260890

[51] Int. Cl.[4] ..... D05B 1/20; D05B 57/06

[52] U.S. Cl. ..... 112/162; 112/199

[58] Field of Search ..... 112/162, 172, 177, 199

[56] References Cited

U.S. PATENT DOCUMENTS

| | | | |
|---|---|---|---|
| 1,989,919 | 2/1935 | Everitt | 112/199 X |
| 4,516,512 | 5/1985 | Bernstein et al. | 112/199 X |
| 4,546,715 | 10/1985 | Mori | 112/162 |

*Primary Examiner*—Wm. Carter Reynolds

*Attorney, Agent, or Firm*—Dennison, Meserole, Pollack & Scheiner

[57] ABSTRACT

An overcasting attachment for use with a sewing machine includes a cross thread guide lever driving mechanism for transmitting the movement of a needle bar interlocking mechanism operatively connected to a needle bar of the sewing machine to an upper cross thread guide lever and a lower cross thread guide lever supported by a base plate. The cross thread guide lever driving mechanism operates to synchronize the movement of the lower cross thread guide lever toward a position of engagement with a bobbin thread and the engagement of a lower cross thread with the upper cross thread guide lever.

2 Claims, 7 Drawing Sheets

OVERCASTING ATTACHMENT FOR USE WITH A SEWING MACHINE

TECHNICAL FIELD

The present invention relates to an overcasting attachment for use with a sewing machine.

BACKGROUND ART

A prior art overcasting attachment for use with a sewing machine is disclosed in U.S. Pat. No. 4,546,715 to the inventor of the present invention, in which the vertical movement of a needle bar of the straight stitch sewing machine is transmitted to a swing lever to be converted into a swinging movement in a horizontal plane, and the movement of the swing lever causes an upper cross thread guide lever and a lower cross thread guide lever to move relatively longitudinally toward and away from a needle through pins movable along corresponding profiled cam slots formed in the swing lever, so that a predetermined thread-engaging operation may be performed to the needle thread and bobbin thread for straight stitching. In forming overcasting stitches, the above process further includes a step of engaging an upper cross thread with a lower cross thread. According to the above patent, while the upper cross thread guide lever is moved substantially in a horizontal plane, the lower cross thread guide lever is swung from up to down to once engage the lower cross thread with the upper cross thread guide lever, and then the upper cross thread guide lever is moved ahead of the lower cross thread guide lever to complete the overcasting stitches. Therefore, the lower cross thread guide lever is required to be swung laterally as well as to be moved vertically at the distal end thereof, and such vertical movement is effected by providing a guide member having a vertical guide slot and by engaging a pin provided at the distal end of the lower cross thread guide lever with the guide slot.

However, in such a construction, the profiled slots and the guide slot are used to impart the predetermined movements on the upper cross thread guide lever and the lower cross thread guide lever. This tends to increase vibration and noise to be generated during movement of the pins in the slots as well as complexity of the construction, so that improvement in this field has been desired.

OBJECT OF THE INVENTION

The primary object of the present invention is to provide an overcasting attachment for use with a sewing machine in which no complicated guide mechanism such as profiled slots is required.

Another object of the present invention is to provide an overcasting attachment for use with a sewing machine in which the noise generated by movement of pins along slots is minimized.

A further object of the present invention is to provide an overcasting attachment for use with a sewing machine which is simple in construction and reliable in operation.

DISCLOSURE OF THE INVENTION

According to the present invention, there is provided an overcasting attachment for use with a sewing machine having a presser bar, a needle bar provided with a needle, and a feed dog, comprising a base plate; a mounting fixture for removably securing the base plate to the presser bar of the sewing machine; a needle bar interlocking mechanism mounted on a portion of the base plate and movable in operative association with the needle bar; an upper cross thread guide lever and a lower cross thread guide lever both supported on the base plate and carrying an upper cross thread and a lower cross thread, respectively, at the respective distal ends thereof; a cross thread guide lever driving mechanism operatively connected to the needle bar interlocking mechanism for transmitting the movement of the needle bar interlocking mechanism to the upper and lower thread guide levers in a manner such that the upper and lower thread guide levers may engage the upper and lower cross threads with a needle thread and a bobbin thread for straight stitching, respectively, in timed relation to the time when the needle passes through a cloth to be sewn and may engage the upper and lower cross threads with each other at a suitable time before the needle passes through the cloth to be sewn; a cloth-pressing member secured to the base plate for pressing the edge of the cloth to be sewn against the feed dog of the sewing machine; and a cloth guide member including a cloth guide portion disposed in front of the cloth-pressing member for slightly raising the edge of the cloth at the needle location, so that the lower cross thread guide lever passes below the cloth, and a stitch width restricting portion disposed laterally of the needle for restricting the width of overcasting stitches; wherein the cross thread guide lever driving mechanism moves the lower cross thread guide lever from above the upper cross thread guide lever to below the same in a substantially straight and relatively inclined manner, as the lower cross thread guide lever moves toward a position of engagement with the bobbin thread for straight stitching; wherein the cross thread guide lever driving mechanism moves the upper cross thread guide lever in a manner such that as the upper cross thread guide lever moves toward a position of engagement with the needle thread for straight stitching, the upper cross thread guide lever moves ahead of the lower cross thread guide lever and passes below and engages a portion of the lower cross thread extending between the distal end of the lower cross thread guide lever and the stitch already formed with the bobbin thread; and wherein the movement of the lower cross thread guide lever toward the position of engagement with the bobbin thread for straight stitching is started in substantially synchronized relation to the engagement of the upper cross thread guide lever with the lower cross thread.

In a preferred embodiment of the invention, during the movement of the upper and lower cross thread guide levers toward the respective positions of engagement with the associated threads for straight stitching, the cross thread guide lever driving mechanism moves the lower cross thread guide lever in a downwardly inclined manner relative to a horizontal plane and moves the upper cross thread guide lever substantially straight in an upwardly inclined manner relative to a horizontal plane.

Preferably, the upper and lower cross thread guide levers are pivotally supported by respective pins mounted on the base plate in an inclined manner relative to a vertical plane.

Preferably, the cross thread guide lever driving mechanism comprises a first rotary member supported by the base plate for rotation in a substantially horizontal plane and adapted to be driven for reciprocating rotation through a predetermined angle, the first rotary member having a pin adjacent a peripheral portion thereof; a second rotary member supported by the base plate for rotation in a plane substantially parallel to the plane of the first rotary member and partly overlapping the first rotary member, the second rotary member having a guide groove substantially radially extending for engagement with the pin of the first rotary member; a first rotation interlocking lever pivotally connected at respective ends thereof to the first rotary member and the upper cross thread guide lever and adapted to convert the reciprocating rotational movement of the first rotary member into a swinging movement of the upper cross thread guide lever; and a second rotation interlocking lever pivotally connected at respective ends thereof to the second rotary member and the lower cross thread guide lever and adapted to convert the reciprocating rotational movement of the second rotary member into a swinging movement of the lower cross thread guide lever.

Preferably, the upper and lower cross thread guide levers are arranged in a manner such that the respective straight lines extending between the connections at the respective opposite ends of the upper and lower cross thread guide levers pass through the respective pivotal points of the first and second rotary members when the upper and lower cross thread guide levers reach the respective positions of engagement with their associated threads for straight stitching.

PREFERRED EMBODIMENT

A preferred embodiment of the present invention will now be described with reference to the accompanying drawings.

Figure 1:
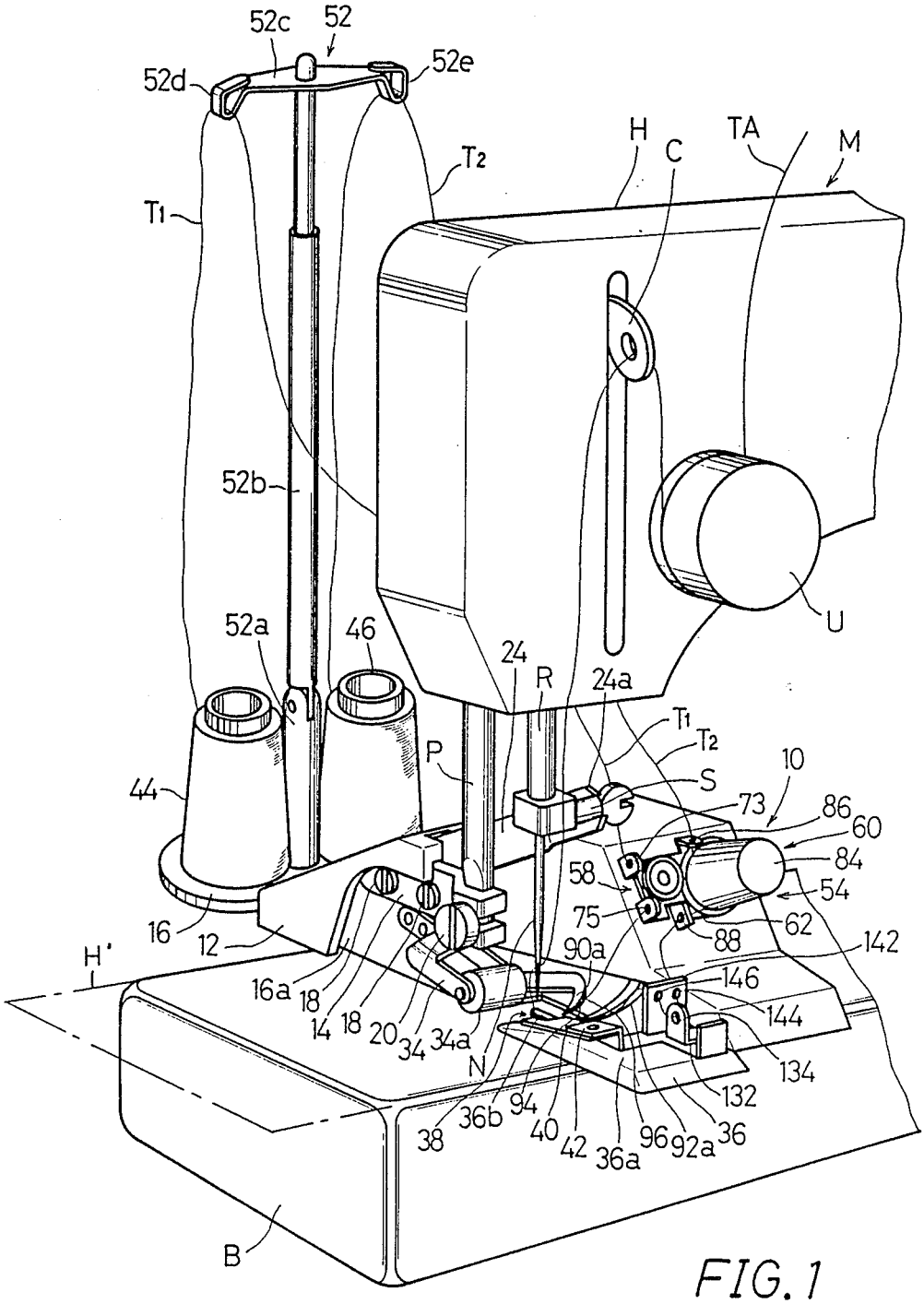
FIG. 1 is a perspective view of an overcasting attachment according to a preferred embodiment of the present invention applied to a sewing machine.

In FIG. 1, an overcasting attachment 10 is illustrated as applied to a straight stitch sewing machine M (only a head H and a part of a bed B are shown). The head H is provided with a presser bar P for attaching a usual presser foot thereto, and a needle N is attached to a needle bar R through a needle clamp screw S, and a needle thread TA for straight stitching is drawn out of a spool held by a spool pin (not shown) and passes through a needle thread tension regulator U and a thread take-up lever C and then through an eye of the needle N.

With reference to FIG. 1, the overcasting attachment 10 includes a cover 12 and a mounting fixture 14 to be attached to the presser bar P. The mounting fixture 14 is secured by set screws 18 to an upstanding portion **16*a* provided on one side edge of a base plate 16 which will be hereinaiter described. The mounting fixture 14 is secured to the presser bar P by a set screw 20 which is threadedly engaged in a threaded hole (not shown) formed in the presser bar P for attaching the usual presser foot thereto. To this end, the mounting fixture 14 has a forked end 14*a* defining a slot 22 through which the set screw 20 is inserted (See FIG. 2**).

Figure 2:
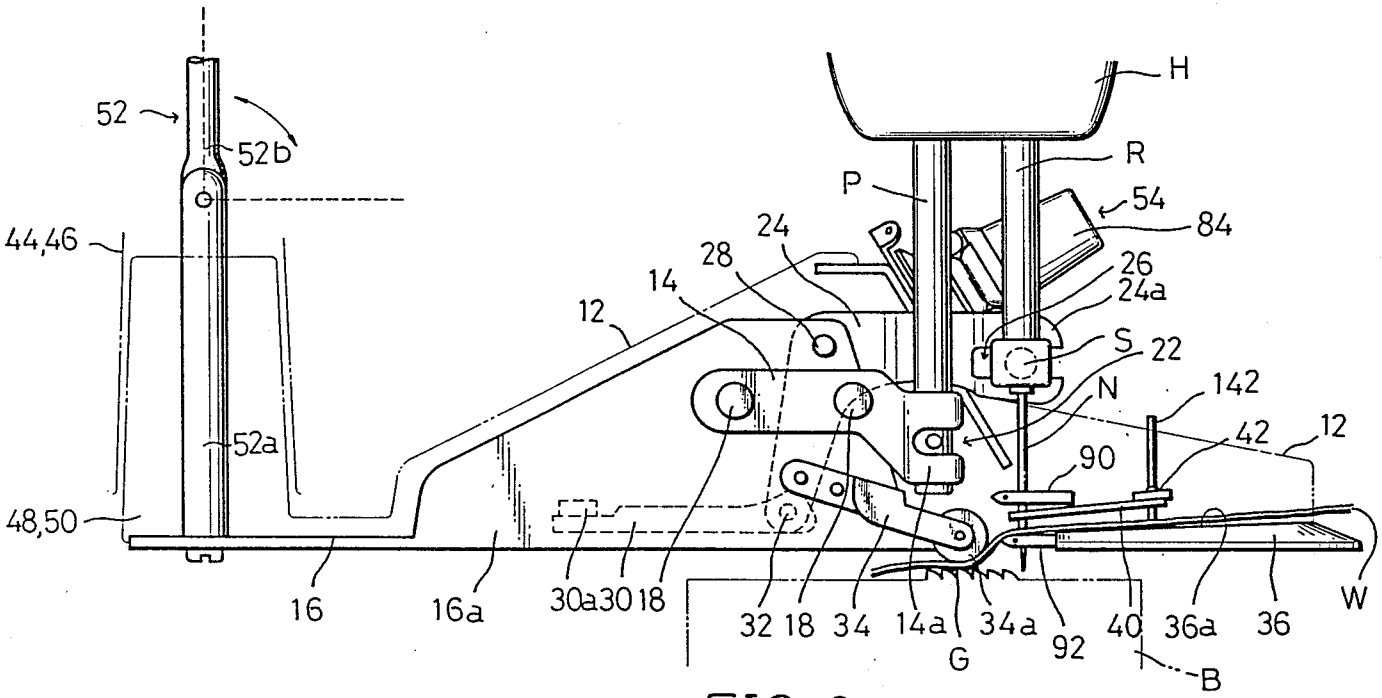
FIG. 2 is a simplified side view showing the sewing operation of the overcasting attachment of FIG. 1.

A first needle bar interlocking lever 24 is connected to the needle bar R so as to be vertically moved in association with the movement of the needle bar R. As shown in FIG. 2, the needle bar interlocking lever 24 has one end **24*a* forked to define a slot 26 which is adapted to be engaged with a shank of the needle clamp screw S. The needle bar interlocking lever 24 is of an inverted L-shaped configuration and is pivoted intermediate the ends thereof to the upstanding portion 16*a* of the base plate 16 through a pin 28 and has the other end pivotally connected to a second needle bar interlocking lever 30 through a pin 32**.

A cloth-pressing foot 34 is disposed immediately behind the needle bar R and is rivetted to the upstanding portion **16*a* of the base plate 16. The cloth-pressing foot 34 includes a roller 34*a* for holding a cloth W against a feed dog G provided in the bed B of the sewing machine M, as shown in FIG. 2**.

Figure 10:
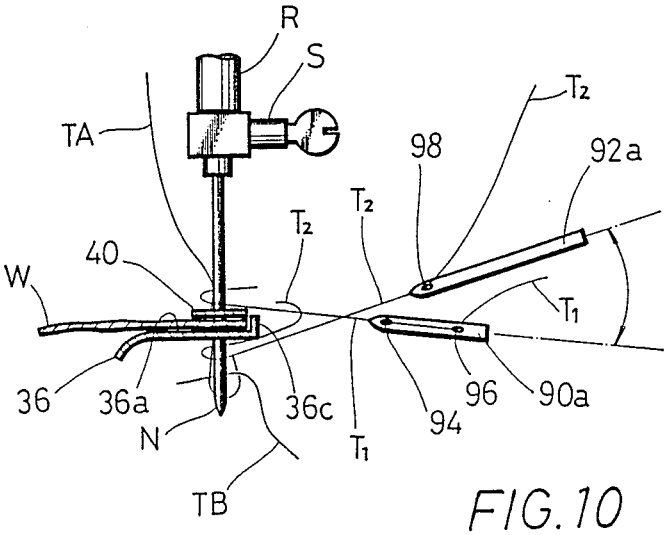
FIG. 10 is a view illustrating the relation between the needle and the upper and lower cross threads when the needle is located substantially in its lowermost position.

A cloth guide member 36 is provided in front of the cloth-pressing foot 34 and is fixed to the base plate 16, the upper surface thereof being provided with a cloth guide surface **36*a*. The cloth guide member 36 has at the rear portion thereof a needle clearance aperture 38 through which the needle N passes, and is provided along the side of the aperture 38 with a projection 36*b* for restricting the width of overcasting stitches (this function will be hereinafter described). The cloth guide member 36 also has at the forward portion of the projection 36*b* an upright portion 36*c* for restricting the side edge of the cloth W guided by the cloth guide surface 36*a*, as shown in FIG. 10**.

A spring plate 40 is provided above the cloth guide member 36 to hold the cloth W in cooperation with the cloth guide surface **36*a*. The spring plate 40 is secured at the front portion thereof to a support plate 42 which is in turn fixed to the base plate 16 and is inclined so that a spacing with respect to the cloth guide surface 36*a*** becomes narrower as it extends rearward.

Bobbins 44 and 46 for supplying an upper cross thread T1 and a lower cross thread T2, respectively, are held by respective bobbin holder bases 48 and 50 (See FIG. 2) provided at the rear portion of the base plate 16. A thread guide rod 52 is mounted on the base plate 16 between the bobbin holder bases 48 and 50. The thread guide rod 52 is composed of a base portion **52*a*, an extensible body portion 52b having a lower end transversely pivotally supported by the base portion 52a, and a thread guide fixture 52c connected to the upper end of the body portion 52b. The thread guide fixture 52c has a pair of hook-shaped thread guide portions 52d and 52e** through which the upper cross thread T1 and the lower cross thread T2 pass.

Figure 3:
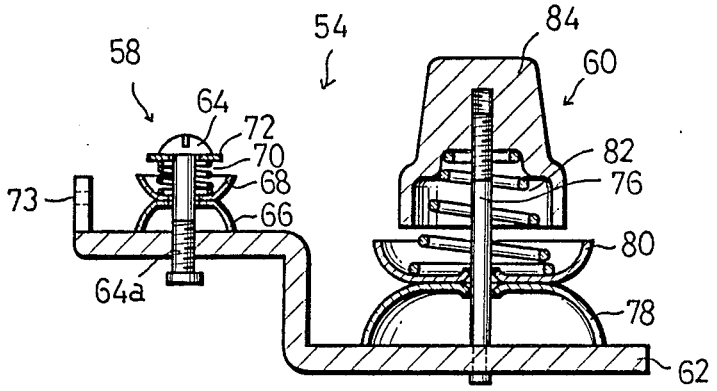
FIG. 3 is an enlarged sectional view of a cross thread tension regulator of the overcasting attachment of FIG. 1.

A cross thread tension regulator 54 is mounted on a mounting base 56 (See FIG. 5) fixed to the base plate 16. The cross thread tension regulator 54 includes an upper cross thread tension regulating unit 58 and a lower cross thread tension regulating unit 60, both of these units have a common thread passing plate 62. As shown in FIG. 3, the upper cross thread tension regulating unit 58 is comprised of a pair of dished plates 66 and 68 through which the shank of a screw 64 threadedly mounted on the thread passing plate 62 extends, a compression spring 70, and a washer 72. Rotation of the screw 64 permits adjustment of the pressing force between the dished plates 66 and 68 developed by the compression spring 70. The thread passing plate 62 has upper cross thread passing holes 73 and 75 formed laterally above and below the dished plates 66 and 68, so that the upper cross thread T1 passed through the upper cross thread passing hole 73 is 1ed between the dished plates 66 and 68 substantially around two thirds of the periphery thereof and then passed through the upper cross thread passing hole 75.

The lower cross thread tension regulating unit 60 includes a pair of dished plates 78 and 80 through which a shaft 76 fixed to the thread passing plate 62 extends, a compression spring 82, and an adjusting knob 84 threadedly engaged with the distal end of the shaft 76. Rotation of the adjusting knob 84 permits adjustment of the pressing orce between the dished plates 78 and 80 developed by the compression spring 82. The thread passing plate 62 has lower cross thread passing holes 86 and 88 disposed above and laterally of the dished plates 78 and 80, so that the lower cross thread T2 passed through the lower cross thread passing hole 86 is led between the dished plates 78 and 80 substantially around three fourths of the periphery thereof and then passed through the lower cross thread passing hole 88 (See FIG. 6).

Figure 4:
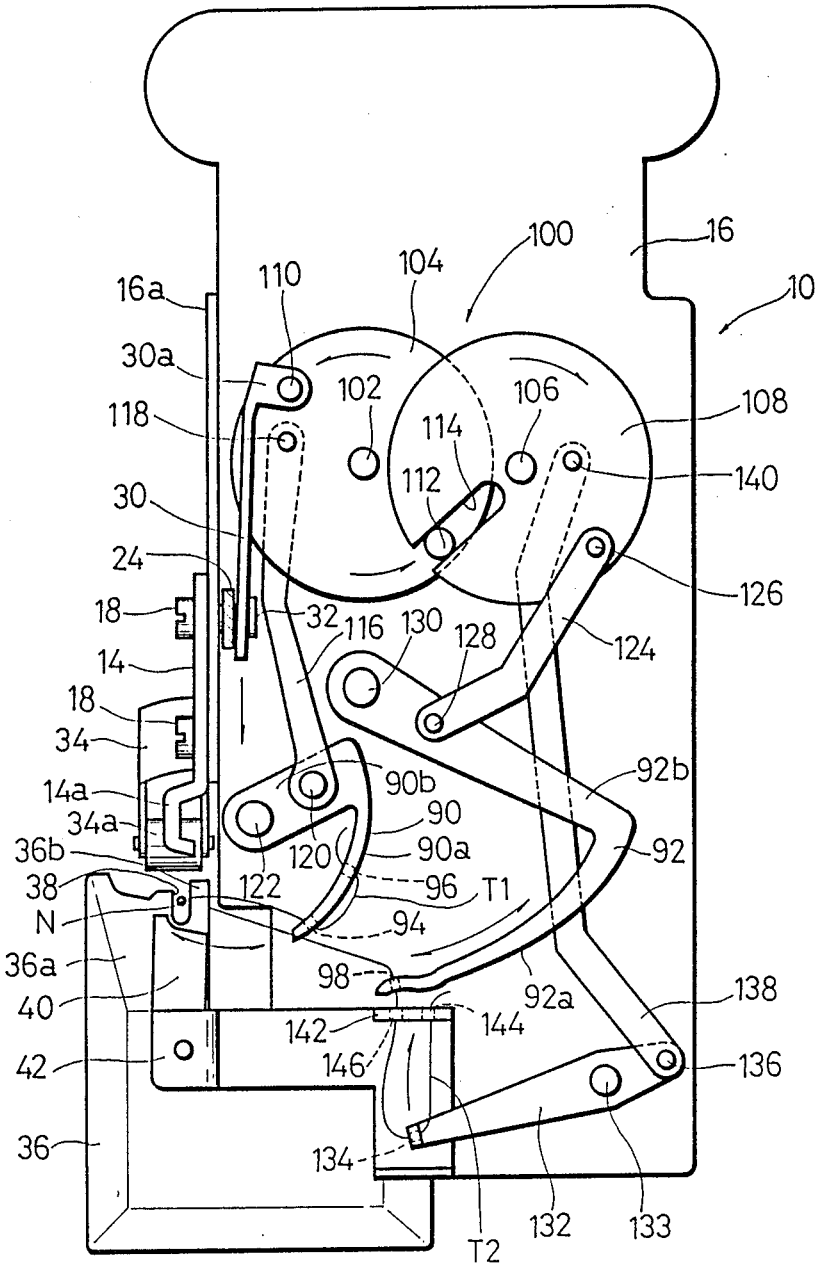
FIG. 4 is a plan view of a mechanism mainly associated with the upper and lower cross thread guide levers, with the cover and several other parts of the overcasting attachment removed, in which the upper cross thread guide lever is engaged with the lower cross thread.
Figure 5:
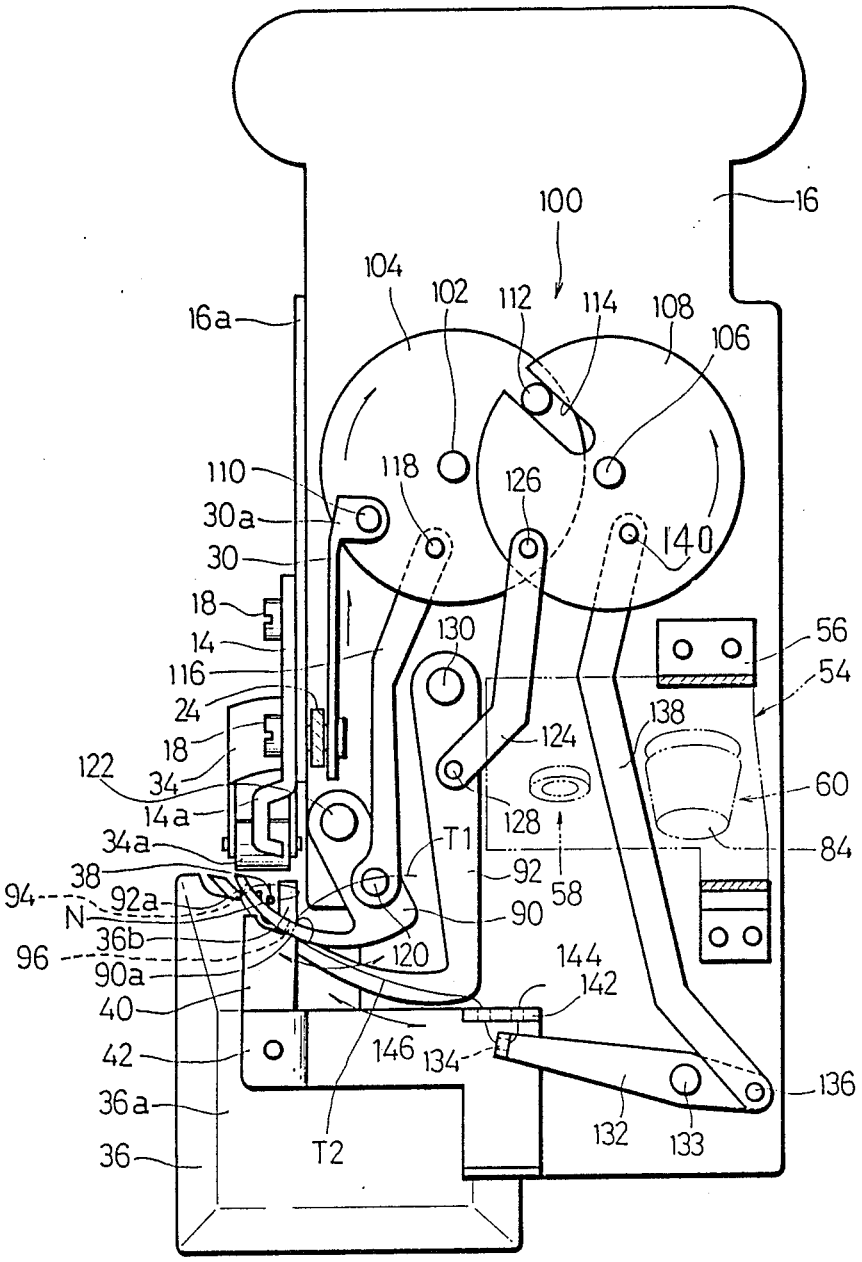
FIG. 5 is a plan view similar to FIG. 4 in which the upper and lower cross thread guide levers have reached the positions where the upper and lower cross threads are engaged with the needle.

As shown in FIGS. 4 and 5, an upper cross thread guide lever 90 and a lower cross thread guide lever 92 are provided on the base plate 16. The upper cross thread guide lever 90 has a sickle-shaped arcuate portion 90a which in turn has upper cross thread passing holes 94 and 96 formed adjacent the distal end thereof and at a position suitably spaced apart therefrom, respectively. The lower cross thread guide lever 92 has a sickle-shaped arcuate portion 92a which in turn has a lower cross thread passing hole 98 formed only at the distal end thereof. The upper cross thread guide lever 90 and the lower cross thread guide lever 92 are driven by a cross thread guide lever driving mechanism 100 operatively associated with the second needle bar interlocking lever 30 shown in FIGS. 4 and 5, and the construction of the cross thread guide lever driving mechanism 100 will be described with reference to FIGS. 4 and 5.

The cross thread guide lever driving mechanism 100 includes a first rotary disc 104 supported rotatably in a horizontal plane by a pivotal shaft 102 fixed to the base plate 16 and a second rotary disc 108 supported rotatably in a horizontal plane by a pivotal shaft 106 fixed to the base plate 16 and having a part extending over a part of the first rotary disc 104 in sliding contact therewith. The first rotary disc 104 has adjacent a peripheral portion thereof a connecting pin 110 which is connected to a horizontal lug 30a formed at one end of the second needle bar interlocking lever 30. Thus, the vertical swinging movement of the first needle bar interlocking lever 24 is converted into a horizontal reciprocating movement of the second needle bar interlocking lever 30 and is then transmitted to the first rotary disc 104, so that the first rotary disc 104 is reciprocatingly rotated through an angle corresponding to the swinging stroke of the lever 24. The first rotary disc 104 has another pin 112 disposed adjacent a peripheral portion substantially in diametrically opposed relation to the connecting pin 110. The pin 112 is engaged with a straight guide groove 114 formed radially in the second rotary disc 108, so that the rotational movement of the first rotary disc 104 is transmitted to the second rotary disc 108 as a reciprocating rotational movement in which the rotational speed is reduced at the end of the rotational movement of the first rotary disc 104.

A first rotation interlocking lever 116 is connected between the first rotary disc 104 and the upper cross thread guide lever 90. Specifically, the first rotation interlocking lever 116 is pivotally connected at one end to the first rotary disc 104 through a pin 118 projecting from the lower surface of the first rotary disc 104 in the vicinity of the connecting pin 110, and is pivotally connected at its other end to a straight portion 90b of the upper cross thread guide lever 90 through a pin 120. The upper cross thread guide lever 90 is pivotally supported at one end by a pivotal shaft 122 which is secured to the base plate 16 in an inclined manner such that it becomes more apart from the needle bar R as it extends upwardly. Thus, during rotation of the rotary disc 104, the upper cross thread guide lever 90 effects, through the first rotation interlocking lever 116, an oblique swinging movement in which as it moves toward the needle bar R, it is raised more upwardly. When the needle bar R is located in its uppermost position, the upper cross thread guide lever 90 is moved to its most pivoted position in a clockwise direction as viewed in the drawing, with the arcuate portion 90a positioned above the cloth guide member 36. On the other hand, when the needle bar R is located in its lowermost position, the upper cross thread guide lever 90 is moved to its most pivoted position in a counterclockwise direction as viewed in the drawing, with the arcuate portion 90a positioned close to the base plate 16. The upper cross thread guide lever 90 is set to move in a manner such that when the needle N is lowered until the needle point reaches the needle clearance aperture 38, the upper cross thread guide lever 90 reaches the most clockwise pivoted position, with the distal end of the arcuate portion 90a passing through and extending beyond the vicinity of the proximal end of the needle clearance aperture 38.

A second rotation interlocking lever 124 is connected between the second rotary disc 108 and the lower cross thread guide lever 92. The second rotation interlocking lever 124 is pivotally connected at one end to the second rotary disc 108 through a pin 126 provided adjacent a peripheral portion of the upper surface of the second rotary disc 108 substantially radially perpendicular to the longitudinal direction of the guide groove 114, and is pivotally connected at its other end thereof to a straight portion 92b of the lower cross thread guide lever 92 through a pin 128. The lower cross thread guide lever 92 is pivotally supported at one end by a pivotal shaft 130 which is secured to the base plate 16 in an inclined manner such that it becomes closer to the needle bar R as it extends upwardly. Thus, during rotation of the second rotary disc 108, the lower cross thread guide lever 92 effects, through the second rotation interlocking lever 124, a specific movement in which as it moves toward the needle bar R, it is lowered more downwardly, so that the distal end of the arcuate portion 92*a* is led below the underside of the cloth guide member 36. The lower cross thread guide lever 92 is set such that when the pivotal shaft 106 of the second rotary disc 108, the pin 126 connecting the second rotary disc 108 to the second rotation interlocking lever 124, and the pin 128 connecting the second rotation interlocking lever 124 to the lower cross thread guide lever 92 are aligned, that is, when the lower cross thread guide lever 92 is moved to its most pivoted position in a clockwise direction as viewed in the drawing, the distal end of the arcuate portion 92*a* passes through and extends beyond the vicinity of the proximal end of the needle clearance aperture 38 below the cloth guide member 36, and during a suitable period of time before and after this occurs, the distal end of the arcuate portion 92*a* is held in the vicinity of the proximal end of the needle clearance aperture 38. The time when the pivotal shaft 106, ihe pin 126 and the pin 128 are aligned in a straight line conforms to the time when the needle N is lowered beyond the needle clearance aperture 38.

A lower cross thread pulling lever 132 is provided obliquely forwardly of the upper cross thread guide lever 90 and the lower cross thread guide lever 92. The lower cross thread pulling lever 132 is supported by a pivotal shaft 133 fixed to the base plate 16 for swinging movement in a direction substantially perpendicular to the levers 90 and 92, and has a thread passing hole 134 formed in one end thereof. The other end of the lower cross thread pulling lever 132 is connected through a pin 136 to one end of a third rotation interlocking lever 138, which is in turn connected at the other end to the second rotary disc 108 through a pin 140 provided on the back of the second rotary disc 108 at a substantially radially central portion adjacent the pin 126. Therefore, the lower cross thread pulling lever 132 may be swung in synchronized relation to the lower cross thread guide lever 92. A thread passing plate 142 is mounted on the base plate 16 behind the lower cross thread pulling lever 132 along a path of movement of the distal end thereof but out of the range of the swinging movement thereof. The thread passing plate 142 has lower cross thread passing holes 144 and 146 associated with the lower cross thread pulling lever 132. The lower cross thread T2 passes through the lower cross thread passing hole 88 of the thread passing plate 62 of the lower cross thread tension regulating unit 60, through the lower cross thread passing hole 144 of the thread passing plate 142, then through the thread passing hole 134 of the lower cross thread pulling lever 132, through the lower cross thread passing hole 146 of the thread passing plate 142 and then through the lower cross thread passing hole 98 of the lower cross thread guide lever 92.

The overall operation of the attachment 10 will now be described.

Figure 6:
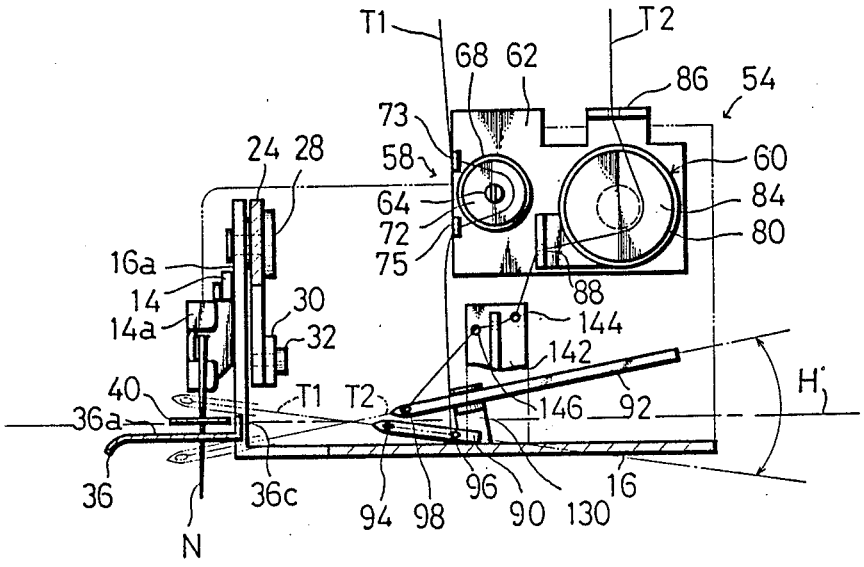
FIG. 6 is a schematic front view illustrating the relation between the needle position and the upper and lower cross thread guide levers.
Figure 7:
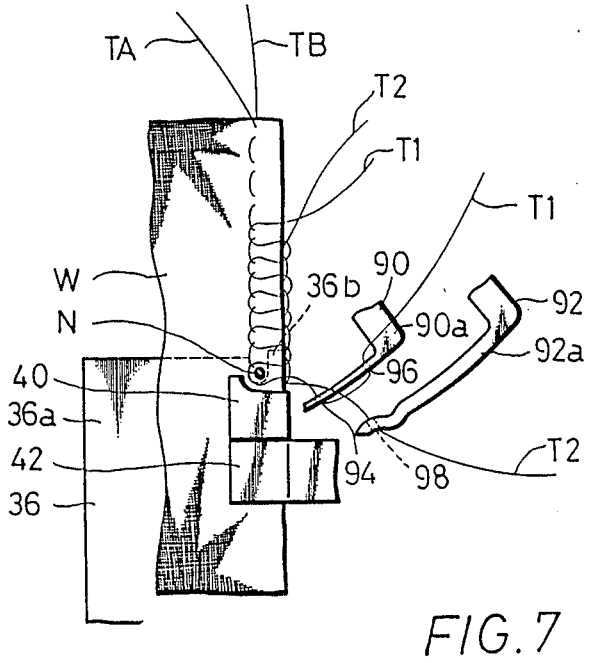
FIG. 7 is a partial plan view corresponding to FIG. 4 and illustrates the relation between the threads and the upper and lower cross thread guide levers.

When the needle N is located in its lowermost position, both of the upper cross thread guide lever 90 and the lower cross thread guide lever 92 are located remotest from the needle bar R, and as shown in FIG. 6, the upper cross thread guide lever 90 is below the lower cross thread guide lever 92. The cross thread guide lever driving mechanism moves the lower cross thread guide lever 92 in a downwardly inclined manner relative to a horizontal plane H' and the upper cross thread guide lever 90 substantially straight in an upwardly inclined manner relative to the horizontal plane H'. Therefore, the upper cross thread T1 and the lower cross thread T2 intersect when looked from the front, as shown in FIG. 6.

Figure 8:
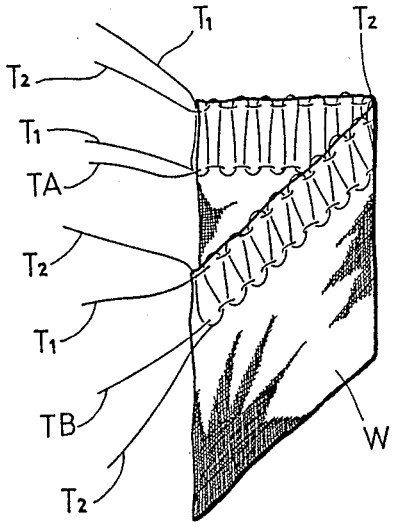
FIG. 8 is a perspective view illustrating the overcasting stitches formed on the edge of the cloth.
Figure 9:
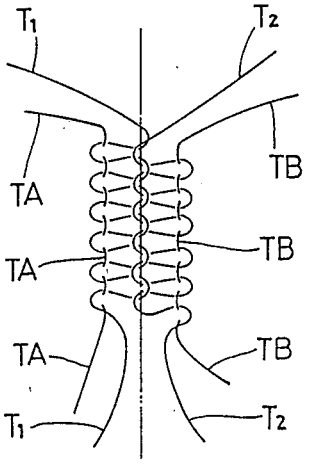
FIG. 9 is a developed view of the overcasting stitches formed by the upper and lower threads.

When the needle N is raised from this position, the startup speed of the lower cross thread guide lever 92 is slow, because it is at the end of its stroke, and therefore, the upper cross thread guide lever 90 is moved obliquely upwardly ahead of the lower cross thread guide lever 92 and engages from underside a portion of the lower cross thread T2 passed through the lower cross thread guide lever 92 and engaged with the bobbin thread TB for straight stitching in the preceding process (See FIGS. 8 and 9).

When the needle bar R is further raised, the lower cross thread pulling lever 132 is pivoted along with the lower cross thread guide lever 92 in a clockwise direction as viewed in FIG. 4, so that the upper cross thread guide lever 90 may be pivoted in engagement with the lower cross thread T2 without applying excessive tension to the lower cross thread T2. When the needle bar R reaches its uppermost position, the arcuate portion 90*a* of the upper cross thread guide lever 90 passes through and extends beyond the vicinity of the proximal end of the needle clearance aperture 38 above the cloth guide member 36, while the arcuate portion 92*a* of the lower cross thread guide lever 92 also passes through and extends beyond the vicinity of the proximal end of the needle clearance aperture 38 below the cloth guide member 36. Specifically, immediately before the needle bar R reaches its uppermost position, the lower cross thread guide lever 92 has reached the most clockwise pivoted position, and when the needle bar R is in its uppermost position, it is slightly returned in a counterclockwise direction. In this condition, the portion of the lower cross thread T2 engaged with the arcuate portion 90*a* of the upper cross thread guide lever 90 and hanging from both sides thereof is restrained by the upstanding portion 36*c* of the cloth guide member 36 from further movement thereover toward the needle bar R.

When the needle bar R is moved downward from this position, the cloth W is fed rearward by a predetermined distance by the feed dog G in accordance with the downward movement of the needle bar R, and the upper cross thread guide lever 90 is returned in a counterclockwise direction to slacken a portion of the upper cross thread T1 between the engagement with the needle thread TA for straight stitching formed in the preceding process and the upper cross thread passing hole 94 at the distal end of the upper cross thread guide lever 90. (The upper cross thread T1 extends from the upper cross thread tension regulating unit 58 and passes through the upper cross thread passing hole 96 of the upper cross thread guide lever 90 from backside and then through the upper cross thread passing hole 94 from forward.) As soon as the slack portion has been formed, the needle N is lowered through the space between the slack portion of the upper cross thread T1 and the arcuate portion 90*a* of the upper cross thread guide lever 90. In accordance with the downward movement of the needle bar R, the lower cross thread guide lever 92 is again pivoted in a clockwise direction from the slightly returned position in the counterclockwise direction, until it reaches the most clockwise pivoted position with its distal end passing through and extending beyond the vicinity of the proximal end of the needle clearance aperture 38 below the cloth guide member 36, and thereafter, it is pivoted counterclockwise in accordance with further downward movement of the needle bar R. This slackens a portion of the lower cross thread T2 engaged with the arcuate portion 90*a* of the upper cross thread guide lever 90 and extending therefrom downward through the lower cross thread passing hole 98 at the distal end of the lower cross thread guide lever 92. As soon as the slack portion has been formed, the needle N is lowered through the space between the slack portion of the lower cross thread T2 and the arcuate portion 92*a* of the lower cross thread guide lever 92. When the needle N passes through the above spaces, the upper cross thread guide lever 90 and the lower cross thread guide lever 92 are located substantially at the same position as viewed in plan in FIG. 5.

As the needle bar R or the needle N is further lowered, the upper cross thread guide lever 90 and the lower cross thread guide lever 92 are further pivoted counterclockwise from the positions shown in FIG. 5, so that the upper cross thread T1 is pulled by the upper cross thread guide lever 90 and the lower cross thread T2 is released from the arcuate portion 90*a* of the upper cross thread guide lever 90 (See FIG. 10). Simultaneouly therewith, the lower cross thread T2 is pulled by the lower cross thread pulling lever 132, and when the needle N reaches its lowermost position, the lower cross thread T2 engages the upper cross thread T1 at the side of the projection 36*b* of the cloth guide member 36 (See FIG. 10).

The above process is repeated to continuously produce overcasting stiches.

I claim:

1. An overcasting attachment for use with a sewing machine having a presser bar, a needle bar provided with a needle, and a feed dog, comprising a base plate; a mounting fixture for removably securing said base plate to said presser bar of said sewing machine; a needle bar interlocking mechanism mounted on a portion of said base plate and movable in operative association with said needle bar; an upper cross thread guide lever and a lower cross thread guide lever both supported on said base plate and carrying an upper cross thread and a lower cross thread, respectively, at the respective distal ends thereof; a cross thread guide lever driving mechanism operatively connected to said needle bar interlocking mechanism for transmitting the movement of said needle bar interlocking mechanism to said upper and lower thread guide levers in a manner such that said upper and lower thread guide levers may engage said upper and lower cross threads with a needle thread and a bobbin thread for straight stitching, respectively, in timed relation to the time when said needle passes through a cloth to be sewn and may engage said upper and lower cross threads with each other at a suitable time before said needle passes through the cloth to be sewn; a cloth-pressing member secured to said base plate for pressing the edge of the cloth to be sewn against said feed dog of said sewing machine; and a cloth guide member including a cloth guide portion disposed in front of said cloth-pressing member for slightly raising the edge of the cloth at the needle location, so that said lower cross thread guide lever passes below the cloth, and a stitch width restricting portion disposed laterally of said needle for restricting the width of overcasting stitches; wherein said cross thread guide lever driving mechanism moves said lower cross thread guide lever from above said upper cross thread guide lever to below the same in a substantially straight and relatively inclined manner, as said lower cross thread guide lever moves toward a position of engagement with said bobbin thread for straight stitching; wherein said cross thread guide lever driving mechanism moves said upper cross thread guide lever in a manner such that as said upper cross thread guide lever moves toward a position of engagement with said needle thread for straight stitching, said upper cross thread guide lever moves ahead of said lower cross thread guide lever and passes below and engages a portion of said lower cross thread extending between the distal end of said lower cross thread guide lever and the stitch already formed with said bobbin thread; wherein the movement of said lower cross thread guide lever toward the position of engagement with said bobbin thread for straight stitching is started in substantially synchronized relation to the engagement of said upper cross thread guide lever with said lower cross thread; wherein during the movement of said upper and lower cross thread guide levers toward the respective positions of engagement with the associated threads for straight stitching, said cross thread guide lever driving mechanism moves said lower cross thread guide lever in a downwardly inclined manner relative to a horizontal plane and moves said upper cross thread guide lever substantially straight in an upwardly inclined manner relative to a horizontal plane; and wherein said cross thread guide lever driving mechanism comprises a first rotary member supported by said base plate for rotation in a substantially horizontal plane and adapted to be driven for reciprocating rotation through a predetermined angle, said first rotary member having a pin adjacent a peripheral portion thereof; a second rotary member supported by said base plate for rotation in a plane substantially parallel to the plane of said first rotary member and partly overlapping said first rotary member, said second rotary member having a guide groove substantially radially extending for engagement with said pin of said first rotary member; a first rotation interlocking lever pivotally connected at respective ends thereof to said first rotary member and said upper cross thread guide lever and adapted to convert the reciprocating rotational movement of said first rotary member into a swinging movement of said upper cross thread guide lever; and a second rotation interlocking lever pivotally connected at respective ends thereof to said second rotary member and said lower cross thread guide lever and adapted to convert the reciprocating rotational movement of said second rotary member into a swinging movement of said lower cross thread guide lever.

2. The overcasting attachment as defined in claim 1 wherein said upper and lower cross thread guide levers are arranged in a manner such that the respective straight lines extending between the connections at the respective opposite ends of said upper and lower cross thread guide levers pass through the respective pivotal points of said first and second rotary members when said upper and lower cross thread guide levers reach the respective positions of engagement with their associated threads for straight stitching.

* * * * *